US006267843B1

(12) United States Patent
Helwig et al.

(10) Patent No.: US 6,267,843 B1
(45) Date of Patent: Jul. 31, 2001

(54) WET-LAID NONWOVEN MAT AND A PROCESS FOR MAKING SAME

(75) Inventors: Gregory S. Helwig, Granville, OH (US); Hendrik Jongetjes, Heerde; Paul Geel, Doorwerth, both of (NL)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/213,068

(22) Filed: Dec. 16, 1998

Related U.S. Application Data

(63) Continuation-in-part of application No. 08/619,785, filed on Mar. 20, 1996, now abandoned.

(51) Int. Cl.[7] ..... D21H 13/40

(52) U.S. Cl. ..... 162/145; 162/146; 162/157.2; 162/156; 162/164.1; 162/168.1; 162/169; 162/135; 162/184; 162/185; 162/186

(58) Field of Search ..... 162/145, 146, 162/157.2, 156, 183, 169, 168.1, 164.1, 135, 184, 185, 186

(56) References Cited

U.S. PATENT DOCUMENTS

| | | | |
|---|---|---|---|
| Re. 34,357 | 8/1993 | Eckert et al. | 428/47 |
| 3,304,282 | 2/1967 | Cadus et al. | 260/37 |
| 3,622,445 | 11/1971 | Heidweiller | 162/145 |
| 3,628,991 | 12/1971 | Thiele et al. | 117/72 |
| 3,883,473 | 5/1975 | Kuesma | 260/42.18 |
| 4,175,154 | 11/1979 | Faust et al. | 428/313 |
| 4,193,841 | 3/1980 | Cederqvist et al. . | |
| 4,220,500 | 9/1980 | Baba et al. | 162/127 |
| 4,318,774 | 3/1982 | Powell et al. | 162/129 |
| 4,424,255 | 1/1984 | Nakamura et al. | 428/283 |
| 4,455,398 | 6/1984 | Budich et al. | 523/220 |
| 4,536,360 | 8/1985 | Rahrig | 264/142 |
| 4,645,565 | 2/1987 | Vallee et al. | 162/123 |
| 4,654,244 | 3/1987 | Eckert et al. | 428/47 |
| 4,692,375 | 9/1987 | Neubauer et al. | 428/299 |
| 4,767,321 | 8/1988 | Chilva | 432/59 |
| 4,793,802 | 12/1988 | Chilva | 432/59 |
| 4,801,627 | 1/1989 | Rahrig et al. | 523/209 |
| 4,802,843 | 2/1989 | Chilva | 432/8 |
| 4,849,281 | 7/1989 | Brandon et al. | 428/280 |
| 4,950,532 | 8/1990 | Das et al. | 428/290 |
| 5,008,145 | 4/1991 | Kinson et al. | 428/288 |
| 5,080,944 | 1/1992 | Kauffman et al. | 428/47 |
| 5,082,708 | 1/1992 | Kauffman et al. | 428/47 |
| 5,154,798 | 10/1992 | Melacini et al. | 162/145 |
| 5,167,765 | 12/1992 | Nielsen et al. | 162/146 |
| 5,188,874 | 2/1993 | Kauffman et al. | 428/47 |
| 5,236,778 | 8/1993 | Landis et al. | 428/282 |
| 5,348,798 | 9/1994 | Berghuis | 428/285 |
| 5,393,379 | 2/1995 | Parrinello | 162/101 |
| 5,409,573 | 4/1995 | Weeks | 162/145 |
| 5,468,437 | 11/1995 | Hall | 264/119 |

FOREIGN PATENT DOCUMENTS

| | | |
|---|---|---|
| 1 154 753 | 4/1958 | (FR) . |
| WO 97/35056 | 9/1997 | (WO) . |

OTHER PUBLICATIONS

Parrinello, Nonwovens Conference, Fiber Geometry Effects on Physical Properties of Chopped Fiber Composites, (Jan. 10, 1990).

*Primary Examiner*—Peter Chin
(74) *Attorney, Agent, or Firm*—Inger H. Eckert

(57) ABSTRACT

A method for making a nonwoven reinforcing may for vinyl floor coverings is described. A base mat is formed from a mixture of glass fibers and polymeric binder fibers and/or powder, follows by treatment with a second water-based polymeric binder composition. The mat has been found to be highly satisfactory as a substrate for compressible vinyl floor covering.

19 Claims, No Drawings

WET-LAID NONWOVEN MAT AND A PROCESS FOR MAKING SAME

DESCRIPTION

This application is a continuation-in-part of Ser. No. 08/619,785 filed Mar. 20, 1996, now abandoned. This application is related to U.S. patent application Ser. No. 08/964,694 for "Reinforced Thermoplastic Composite System," filed Nov. 6, 1997.

TECHNICAL FIELD

Vinyl floor coverings containing a reinforcing layer of glass fiber mat are widely used in residential construction, particularly in Europe. Unlike organic felt or paper carriers, the glass mat provides a dimensionally-stable substrate for coating and printing operations during production of the floor covering. Placement of the reinforcement layer near the center of the structure yields a product that resists curling, making the floor covering suitable for loose-lay installations.

Problems exist when the floor covering is installed over a wood subfloor due to the fairly large dimensional changes associated with wood as the temperature and humidity change. As the subfloor "dries out" in the winter, it can shrink by as much as 0.5 percent. Unless the vinyl floor covering can accommodate this change in dimension through compression, the vinyl floor covering may buckle to relieve the compressive loading.

The glass mats currently used as the reinforcing layer in vinyl floor covering have high compressive strengths which can result in severe buckling when they are installed over wood subfloors. A typical reinforcing mat used in floor coverings consists of glass textile fibers with a diameter of 9 to 11 microns and length of 6 mm. These fibers are typically held together with a rigid binder such as a ureaformaldehyde resin or poly(vinyl alcohol). The high compressive stiffness of these reinforcing mats is not substantially altered during the manufacturing of the floor covering.

U.S. Pat No. 4,849,281 discloses one solution to the problem of the high compressive stiffness of the glass reinforcing layer. The glass mat of that patent consists of a blend of glass textile fibers and glass wool fibers. These fibers are bonded with an elastomeric binder consisting of a mixture of a carboxylated styrene-butadiene latex and a methylated melamine-formaldehyde resin.

DISCLOSURE OF INVENTION

We have now invented a new wet-laid mat which is to be used as a reinforcing layer in surface coverings, particularly vinyl floor coverings. The wet-laid mat of the present invention consists of a blend of glass textile fibers and polymeric binder fibers and/or polymeric binder powder with a secondary polymeric binder to achieve a compressible substrate for vinyl flooring.

The general procedure for preparing the mat is as follow. A slurry of glass textile fibers, polymeric binder fibers and/or polymeric binder powder, and optionally poly(vinyl alcohol) powder or fiber are formed into a mat using conventional wet-laid forming techniques, which are well known to those practiced in the art. The resulting nonwoven web is passed through an oven to dry the mat and fuse the binder fibers and/or powder. We then apply a secondary binder by saturating the mat with a water-based polymer solution or dispersion, removing the excess binder and again passing the mat through an oven to dry and cure the secondary binder. When the resulting mat is substituted for conventional glass mats in typical vinyl floor covering constructions, a marked improvement in compressive behavior is found. Floor coverings containing the new mat are thus highly suitable for use over wood subfloors.

In an alternative embodiment, we can provide a slurry of glass fibers and one or more polymeric binder fibers and/or powders, and dewater the slurry to form a wet-laid mat. Next, we apply a secondary water-based binder to the wet-laid mat, dewater a second time and then dry the mat to fuse the binders to the glass fibers.

In still another alternative embodiment, we can provide a slurry of glass fibers and one or more polymeric binder fibers and/or powder, dewater the slurry to form a wet-laid mat and dry the mat to fuse the binders to the glass fibers. Next, we roll up the mat without applying the secondary binder. We then can apply the secondary binder at a later time in separate off-line process steps.

The slurries in either or both alternative embodiments may further include poly(vinyl alcohol) powder or fiber.

The general procedure of preparation of the mat is as follows. A slurry of glass textile fibers and organic polymeric binder fibers and/or powder, and optionally, poly (vinyl alcohol) powder or fiber is prepared at a concentration of 0.1 to 4.0 percent in water. The organic polymeric binder may be added as fiber, powder, or a combination of fibers and powder. The water may also contain viscosity modifiers, surfactants, and defoaming agents that are commonly used in the manufacture of wet-laid nonwovens. Proportions of the materials may be in the range of 50 to 90 percent glass, 10 to 50 percent binder fiber, binder powder, or mixtures thereof, and 0 to 15 percent poly(vinyl alcohol). After the fibers have dispersed, the slurry is transferred to the forming section of an inclined-wire Fourdrinier machine and dewatered. The resulting web is passed through an oven to dry the mat and fuse the binder fibers and/or binder powder. A secondary binder is then applied by saturating the dry mat with a water-based polymer composition and removing the excess with a vacuum slot. The mat is then passed through a second oven where it is again dried and the binder cured. This product would then be used in the manufacture of a sheet vinyl flooring product in much the same way that wet-laid glass mats are currently used in the flooring industry.

An alternative process we use is a process for producing a wet-laid nonwoven comprising the steps of providing a slurry of glass fibers and one or more polymeric binder fibers and/or polymeric binder powders; dewatering the slurry to form a wet-laid nonwoven mat; applying a secondary water-based binder to the wet-laid mat; removing excess water from the saturated mat; and drying and curing the mat to form a finished nonwoven mat.

The second alternative we use includes the steps of providing a slurry of glass fibers and one or more polymeric binder fibers and/or polymeric binder powders, removing excess water from the saturated mat, and drying the mat. We then roll up the mat without applying the secondary binder. At a later time in a separate off-line process, we apply the secondary water-based binder, remove the excess water with a vacuum and then pass the mat through an oven to dry and cure the binder.

In the various processes of our invention, we use machines such as wire cylinders, Fourdrinier machines, Stevens Former, Roto Former, Inver Former and Venti Former machines to form the wet-laid mat. A head box deposits the slurry onto a moving wire screen. Suction or vacuum removes the water which results in the wet-laid mat. Conventional ovens perform the drying and fusing steps.

Conventional glass-reinforced flooring products are too dimensionally stable to be applied successfully over wood subfloors. Contraction of the subfloor as the wood dries out during the winter months applies a compressive strain to the vinyl flooring. If the floor covering is unable to dissipate the compressive loading through in-plane movement, the material will deflect vertically, resulting in buckling or doming of the floor covering. Standard glass mats consisting of glass textile fibers and a rigid binder do not allow this in-plane movement.

We have found, however, that glass textile fibers bonded with polymeric binder fibers and/or polymeric binder powders provide a mat that when encapsulated with typical vinyl plastisols yields a floor covering with substantial capability for in-plane movement. A simple combination of glass and binder fibers and/or powders is less preferable in a flooring mat because the binder fibers and/or powders will tend to soften or melt at the temperatures needed to gel the vinyl plastisols applied by the flooring manufacturer. Excessive softening of the binder at this point would result in stretching or tearing of the web.

This problem can be avoided through the use of a secondary binder which retains some of its strength at the gelation temperature. A secondary binder provides additional strength and dimensional stability to the web in the initial stages of processing by the floor covering manufacturer. This added stability helps prevent creasing and tearing of the mat during the coating operations. Dimensional stability is particularly desirable during the printing operation to allow for the proper registration of multi-color patterns.

In order to provide the desired compressive behavior, the strength contributed by the secondary binder must be reduced or eliminated in the final flooring product. The composition of this secondary binder is preferably chosen so that the binder will be plasticized or dissolved at the higher temperatures seen by the flooring during the expansion of the formable plastisol. Conventional binders used in glass flooring mats such as urea-formaldehyde resins and poly (vinyl alcohol) are not affected by the plasticizers normally used in vinyl plastisols. Even greater levels of compressive movement can be achieved if the polymeric binder fiber is chosen so that it is also softened by the plasticizer.

The glass fibers used in the practice of this invention typically range from 6.5 to 13.5 microns in diameter and from 3 mm to 25 mm in length. The glass fibers for the wet-laid mats of this invention are made from any standard composition for making continuous glass fiber strands for reinforcement or textile uses. E glass is the most common glass for making textile and reinforcement glass fibers. See U.S. Pat. No. 2,334,961. Other standard glasses for making continuous glass fiber strands include C glass and ECR glass. See U.S. Pat. Nos. 2,308,857 and 4,026,715 respectively.

Suitable binder fibers will achieve their bonding effect in the temperature range of 120 to 220° C. The compositions of such fibers include polyolefins, copolyesters, vinyl acetate copolymers, and vinyl chloride copolymers. Suitable examples of such fibers include Wacker Type MP, a vinyl chloride copolymer fiber and Celbond 105 bicomponent binder fiber from Hoechst-Celanese which has a polyester core and a polyolefin sheath.

The binder may be added to the slurry as fibers, powder, or combination of the two forms. While binder powder tends to settle more quickly in the slurry than binder fibers, powder is generally less expensive than fiber and may be added to the slurry more easily. Binder powder may also be sprinkled or otherwise evenly dispersed directly onto the wet-laid mat. A wider variety of binders are also commercially available in powder form than in fiber form. A non-exclusive list of suitable binder powders includes polyolefins, copolyesters, vinyl acetate copolymers, polyamides, and vinyl chloride polymers. Suitable powders include nylon powders, such as Orgasol 2001 EXD NAT 1 polyamide; Orgasol 2001 UD NAT1 polyamide; and Orgasol 2001 UD NAT2 polyamide, and have a molecular weight ranging from about 12,000 to about 65,000. In a preferred embodiment, the molecule weight ranges from about 18,000 to about 50,000. A preferred powder is orgasol polyamide 12 (obtained from Elf Atochem North America).

The preferred powder binder material is poly(vinyl chloride), i.e., PVC. The PVC can be vinyl chloride homopolymer or copolymers of vinyl chloride copolymerized with at least one other copolymerized monomer. Preferably, the PVC is vinyl chloride homopolymer. The particle size of the PVC powder binder is preferably 50–250 $\mu$m. Powder binder within this particle size range disperses well in suspension. Most commercially available PVC powders can be passed through an appropriately sized sieve to separate the desired particle size fraction. Preferably, the PVC material includes heat stabilizers known to those skilled in the art. Suitable powdered binders are available from Geon Company, Avon Lake, Ohio.

The previously-mentioned secondary binders can also vary widely. A non-exclusive list of suitable compositions includes styrene-butadiene, acrylic, styrene-acrylic, vinyl acetate-acrylic and vinyl acetate-ethylene copolymers. Depending on the composition of the base mat and the degree of high temperature strength needed for processing by the flooring manufacturer, these compositions may be non-crosslinking, self-crosslinking or may be crosslinked by addition of a suitable agent such as melamine-formaldehyde resin.

In the following examples, the wet-laid mats that are the subject of this invention were converted into finished flooring structures using techniques well-known in the industry. Sheets of vinyl-encapsulated mat were tested for in-plane compressive ability in the following manner. Rectangular pieces were placed in a test fixture that keeps the sheet from deflecting out of the plane of the applied load. The test materials were then subject to a compressive strain of 0.31% and the resulting load was measured with a load cell. With a rate depending on the composition of the sheet, the initial applied load will slowly decay. A value taken after 1,000 hours has been found to be indicative of the ability of the flooring structure to dissipate the strain energy created by subfloor movement. Conventional glass-based floor coverings, which are known to buckle when applied to wood subfloors, typically yield values of 3.0 to 5.0 lbs./in. in this test. Flooring products based on the compressible sheet described in U.S. Pat. No. 4,849,281 give load values in the range of 1.5 to 2.5 lbs./in. These structures have been used in actual floor installations without buckling problems. As shown in the table, the wet-laid mats that are the subject of this invention yield values in the range of 1.0 to 2.5 lbs./in.

EXAMPLE 1

In a preferred embodiment, a base mat with a weight of 51 g/m$^2$ was prepared from a mixture of 65 percent-by-weight glass fibers (11$\mu$×6 mm), 26 percent vinyl acetate binder fiber (Type MP, 3.3 dtex×6 mm sold by Wacker AG), and 9 percent poly (vinyl alcohol) powder (Denka Poval). To the base mat, we applied a styrene-acrylate copolymer emulsion (Acronal 168D sold by BASF), giving an add-on 10 g/m$^2$ and bringing the total weight of the mat to 61 g/m$^2$.

Examples 2–6 and Comparative Example A

As summarized in the table, other suitable examples can be prepared from various materials. Poly(vinyl alcohol) fiber (Type VPB101 from Kuraray Co.) may be substituted for the poly(vinyl alcohol) powder. In a similar manner, we may substitute as the binder fiber Celbond 105 (Hoechst-Celanese), which is a bicomponent fiber consisting of a polyester core and a polyolefin sheath. Several other suitable examples of secondary binders are Wacker EP177, a non-crosslinking ethylene-vinyl acetate copolymer; Airflex 124, a self-crosslinking ethylene-vinyl acetate copolymer sold by Air Products; Dow Latex 485 a carboxylated styrene-butadiene copolymer. In Comparative Example A, the binder fiber was omitted to demonstrate the effect of this component on the compressive behavior of the floor covering.

A standard vinyl floor covering using a standard glass fiber mat for Europe has a load ranging from 3.5 to 4.5 lbs./in. when subjected to a compressive strain of 0.31% for 1000 hours. The values of Examples 1 to 6 are substantially better than the European standard.

TABLE 1

| | 1 | 2 | 3 | 4 | 5 | 6 | A |
|---|---|---|---|---|---|---|---|
| Base mat components (% by wt.) | | | | | | | |
| Glass fiber | 65 | 64 | 70 | 67 | 65 | 67 | 93 |
| Wacker MP fiber | 26 | 27 | 27 | 27 | 25 | — | — |
| Celbond 105 fiber | — | — | — | — | — | 30 | — |
| PVAI powder | 9 | — | 3 | 6 | 10 | 3 | 7 |
| Base mat wt. (g/m$^2$) | 51 | 53 | 49 | 46 | 46 | 46 | 47 |
| Secondary binder add-on (g/m$^2$) | | | | | | | |
| Wacker EP177 | — | — | — | 12 | — | 11 | — |
| Airflex 124 | — | — | 10 | — | — | — | 10 |
| Dow Latex 485 | — | — | — | — | 11 | — | — |
| Acronal 168 D | 10 | 10 | — | — | — | — | — |
| Total mat wt. (g/m$^2$) | 61 | 63 | 59 | 58 | 57 | 57 | 57 |
| Coated mat wt. (lbs/yd$^2$) | 4.09 | 4.11 | 4.16 | 4.36 | 4.51 | 4.71 | 4.13 |
| Expanded thickness (mil) | 83.1 | 86.5 | 86.3 | 96.2 | 92.4 | 98.2 | 79.7 |
| Load at 0.31% compression after 1000 hr. (lbs./in.) | 2.3 | 2.3 | 2.3 | 1.1 | 1.5 | 1.4 | 3.6 |

What is claimed is:

1. A compressible wet-laid nonwoven mat reinforcement for polymerized resin compositions comprising:

a resin composition;

a base web comprised of 50 to 90 percent by weight glass fibers, 10 to 50 percent organic polymeric binder, and 0 to 15 percent poly(vinyl alcohol); and a secondary binder comprising 5 to 40 percent of the total mat weight, said secondary binder being soluble in or plasticized by said resin composition.

2. A nonwoven mat according to claim 1 wherein the glass fibers have a diameter of 6.5 to 13.5 microns and a length of 3 to 25 mm.

3. The non-woven mat of claim 1, wherein the polymeric binder is selected from the group consisting of polyolefins, copolyesters, vinyl acetate copolymers, polyamides, vinyl chloride polymers, and mixtures thereof.

4. A nonwoven mat according to claim 3 wherein the polymeric binder includes vinyl chloride polymer.

5. A nonwoven mat according to claim 4 wherein the vinyl chloride polymer is a powder having a particle size of about 50 to about 250 $\mu$m.

6. A nonwoven mat according to claim 1 wherein the polymeric binder includes fibers consisting of a polyolefin sheath and a polyester core.

7. A nonwoven mat according to claim 1 wherein the secondary binder is selected from the group consisting of acrylic copolymers, styrene-acrylic copolymers, vinyl acetate-acrylic copolymers, styrene-butadiene copolymers, vinyl acetate-ethylene copolymers, and vinyl acetate homopolymers.

8. A nonwoven mat according to claim 1 wherein the secondary binder is a styrene-acrylate copolymer.

9. A nonwoven mat according to claim 1 wherein the secondary binder is a styrene-butadiene copolymer.

10. A nonwoven mat according to claim 1 wherein the secondary binder is a vinyl acetate-ethylene copolymer.

11. A reinforcing substrate for a polymerzcd resin composition surface covering consisting essentially of a wet-laid nonwoven mat comprsing a resin composition; a base web comprised of 50 to 90 percent by weight glass fibers, 10 to 50 percent organic polymeric binder, and 0 to 15 percent poly(vinyl alcohol); and a second binder comprising 5 to 40 percent of the total mat weight, said secondary binder being soluble in or plasticized by said resin composition.

12. A substrate according to claim 11 wherein the secondary binder is selected from the group consisting of acrylic copolymers, styrene-acrylic copolymers, vinyl acetate-acrylic copolymers, styrene-butadiene copolymers, vinyl acetate-ethylene copolymers and vinyl acetate homopolymers.

13. A substrate according to claim 11 wherein the surface covering resin composition is a vinyl composition including a plasticizer and wherein the secondary binder is plasticized by or dissolves in the plasticizer.

14. A substrate according to claim 13 wherein both the secondary binder and the polymeric binder are plasticized by or dissolved in the plasticizer.

15. A substrate according to claim 13 wherein the plasticized binder has a viscoelastic flow which dissipates any compressive load during compressive movement of the surface covering.

16. The substrate of claim 11, wherein the polymeric binder is selected from the group consisting of polyolefins, copolyesters, vinyl acetate copolymers, polyamides, vinyl chloride polymers, and mixtures thereof.

17. The substrate of claim 16, wherein the polymeric binder includes vinyl chloride polymer.

18. The substrate of claim 17, wherein the vinyl chloride polymer is a powder having a particle size of about 50 to about 250 $\mu$m.

19. A compressible wet-laid nonwoven mat reinforcement for polymerized resin compositions comprising:

a resin composition;

a base web comprised of 50 to 90 percent by weight glass fibers, 10 to 50 percent organic polymeric binder powder, and 0 to 15 percent poly(vinyl alcohol); and a secondary binder comprising 5 to 40 percent of the total mat weight, said secondary binder being soluble in or plasticized by said resin composition.

* * * * *